United States Patent [19]

Howard, Jr.

[11] Patent Number: 4,523,639

[45] Date of Patent: Jun. 18, 1985

[54] RAM TYPE BLOWOUT PREVENTERS

[75] Inventor: Roland M. Howard, Jr., Houston, Tex.

[73] Assignee: Koomey Blowout Preventers, Inc., Houston, Tex.

[21] Appl. No.: 553,529

[22] Filed: Nov. 21, 1983

[51] Int. Cl.[3] ..... E21B 33/06

[52] U.S. Cl. ..... 166/55; 166/323; 251/1 A

[58] Field of Search ..... 166/55, 323; 251/1 A, 251/1 R

[56] References Cited

U.S. PATENT DOCUMENTS

| | | | |
|---|---|---|---|
| 3,941,141 | 3/1976 | Robert | 251/1 A |
| 4,076,208 | 2/1978 | Olson | 251/1 A |
| 4,290,577 | 9/1981 | Olson | 251/1 A |
| 4,305,565 | 12/1981 | Abbe | 251/1 A |

*Primary Examiner*—Stephen J. Novosad
*Assistant Examiner*—William P. Neuder
*Attorney, Agent, or Firm*—Vaden, Eickenroht, Thompson & Jamison

[57] ABSTRACT

There is disclosed a ram-type blowout preventer having shear rams and fluid operated actuators for the shear rams which are of such construction as to move the rams inwardly to shear a pipe with a first, relatively large force, and then further inwardly to close the rams with a second, relatively small force, and which also includes locking elements adapted to be moved into positions locking the rams in closed positions automatically in response to inward movement of the rams to closed positions following shearing of the pipe.

16 Claims, 6 Drawing Figures

RAM TYPE BLOWOUT PREVENTERS

This invention relates generally to blowout preventers of the type having rams which are adapted to shear a pipe such as a drill string within the bore of the housing of the preventer, as the rams move inwardly from open position, and then, upon continued inward movement, to seal with respect to one another and with respect to guideways in the housing of the preventer in which the rams move in order to close the bore. Thus, the upper sheared end of the drill string may be pulled from the well bore when it becomes desirable to move the drilling rig away from the well in a short time.

More particularly, this invention relates to improvements in blowout preventers having fluid-operated actuators of such construction as to move the rams inwardly to shear the pipe with a first, relatively large axial force, and then move them further inwardly to close the bore with a second, relatively small force, whereby it is possible to shear the pipe without developing excessive pressures in the ram packings which seal between the rams and between the rams and their guideways.

Thus, as shown in copending application, Ser. No. 446,390, filed Dec. 2, 1982, and entitled "Valves", and assigned to the assignee of the present application, the actuator for each shear ram includes first and second pistons sealably reciprocable with respect to one another and with the cylinder, respectively, and means for selectively supplying control fluid to or exhausting control fluid from opposite sides of the pistons within the cylinders to either urge them toward or away from the housing bore. More particularly, a rod connects each ram to the first piston for inward and outward movement with it, and the second piston has a lost motion connection with the first piston so that it is engageable with the first piston, in response to the supply of operating fluid to the outer sides of the pistons, to move the rams inwardly to shear the pipe with a first force due to such fluid acting over both pistons. However, a shoulder is provided within each cylinder for stopping inward movement of the second piston, when the rams have been moved inwardly to shear the pipe, and the rod continues to move inwardly with the first piston to cause the rams to seal with one another and their guideways with a relatively small force due to control fluid acting over only the first piston.

Another copending application, Ser. No. 461,761, filed Jan. 31, 1983, and entitled "Fluid Operated, Axially Reciprocating Actuator", and also assigned to the assignee of the present application, relates to a ram type blowout preventer wherein the rod of the actuator connecting with each ram is locked against return movement to its outer position (to open the ram) automatically in response to movement into its inner position (to close the ram), whereby operating fluid may be exhausted from the outer side of piston means on the rod within the cylinder of the actuator. More particularly, the rod is adapted to be unlocked for return movement automatically in response to the end-for-end reversal of the supply and exhaust of operating fluid to and from opposite sides of the piston means. Although the actuator is of much simpler construction than other actuators having automatic ram locks, such as shown in U.S. Pat. Nos. 3,242,826 and 4,305,565, as well as on page 1432 of the 1980-81 issue of the *Composite Catalog of Oil Field Equipment & Services,* all are particularly unsuited for locking the rams of application, Ser. No. 446,390, in closed position, in that each has radially contractable and expandible locking elements carried by the rod for sliding along the inner diameter of the cylinder into and out of positions opposite an outwardly extending locking shoulder adjacent the inner end of the cylinder. Thus, as these actuators are constructed, these locking elements would be unable to move axially inwardly past a shoulder in the cylinder positioned to engage the outer piston in order to stop its inward movement following shearing of a pipe.

It is therefore the primary object of this invention to provide, in a blowout preventer having shear rams, a fluid-operated actuator of such construction as to not only move the rams inwardly to shear the pipe with a first relatively large force, and then continue to move them inwardly to closed position with a second relatively small force, but also automatically lock the ram in closed position by means of locking elements carried by the ram connecting rod for locking engagement with a locking shoulder adjacent the inner end of the cylinder of the actuator.

This and other objects are accomplished, in accordance with the illustrated embodiment of the present invention, by a blowout preventer having an actuator for each of its shear rams which includes a cylinder having an inwardly facing locking shoulder near its inner end and an outwardly facing stop shoulder outwardly of the locking shoulder, an axially reciprocal rod which extends from the cylinder into the ram chamber for connecting with the ram therein, a pair of pistons which are sealably reciprocable with respect to the rod and cylinder, respectively, and with respect to one another, and which have a lost motion connection between them, and means for alternately supplying operating fluid to and exhausting operating fluid from the cylinder on opposite sides of the pistons in order to move the pistons inwardly and outwardly. Locking elements are disposed about the rod for movement inwardly and outwardly therewith and for expansion and contraction between contracted positions in which they move with the rod past the stop shoulder, into and out of positions opposite the locking shoulder, and expanded positions in which they are engageable with the locking shoulder to lock the rams in closed position, and a means is provided for engaging with the stop shoulder to stop inward movement of one of the pistons, when the pipe has been sheared, and holding the locking elements in contracted position, as they move axially inwardly with the rod and other piston beyond the stop shoulder, and then releasing the locking elements for radial expansion into locking engagement with the locking shoulder, as the rod continues to move inwardly with the other piston to move the ram connected to the rod to closed position. More particularly, a means is provided for expanding the locking elements into engagement with the locking shoulder, in response to inward movement of the other piston with respect to the rod, and for releasing the locking elements from locking engagement, in response to outward movement of the other piston with respect to the rod, whereby the locking elements may be be contracted and moved outwardly with the rod and other piston beyond the stop shoulder as the rams are withdrawn to open position.

In the preferred and illustrated embodiment of the invention, the one piston whose inward movement is stopped when the pipe has been sheared is the outer piston which is sealably reciprocable within the cylinder, and the means for engaging the stop shoulder and holding the locking elements in contracted position comprises a ring which is axially reciprocable within the cylinder and which surrounds the locking elements to hold them in contracted position. More particularly, the ring is separate from the one piston and is engageable thereby upon continued inward movement of the one piston following engagement of the ring with the stop shoulder, and spring means acts between the ring and the one piston to maintain the ring against the stop shoulder, and thus in position to receive and hold the locking elements retracted, as the one piston is moved axially outwardly during the initial phase of return movement of the ram to open position.

In the drawings, wherein like reference characters are used throughout to designate like parts:

Figure 1:
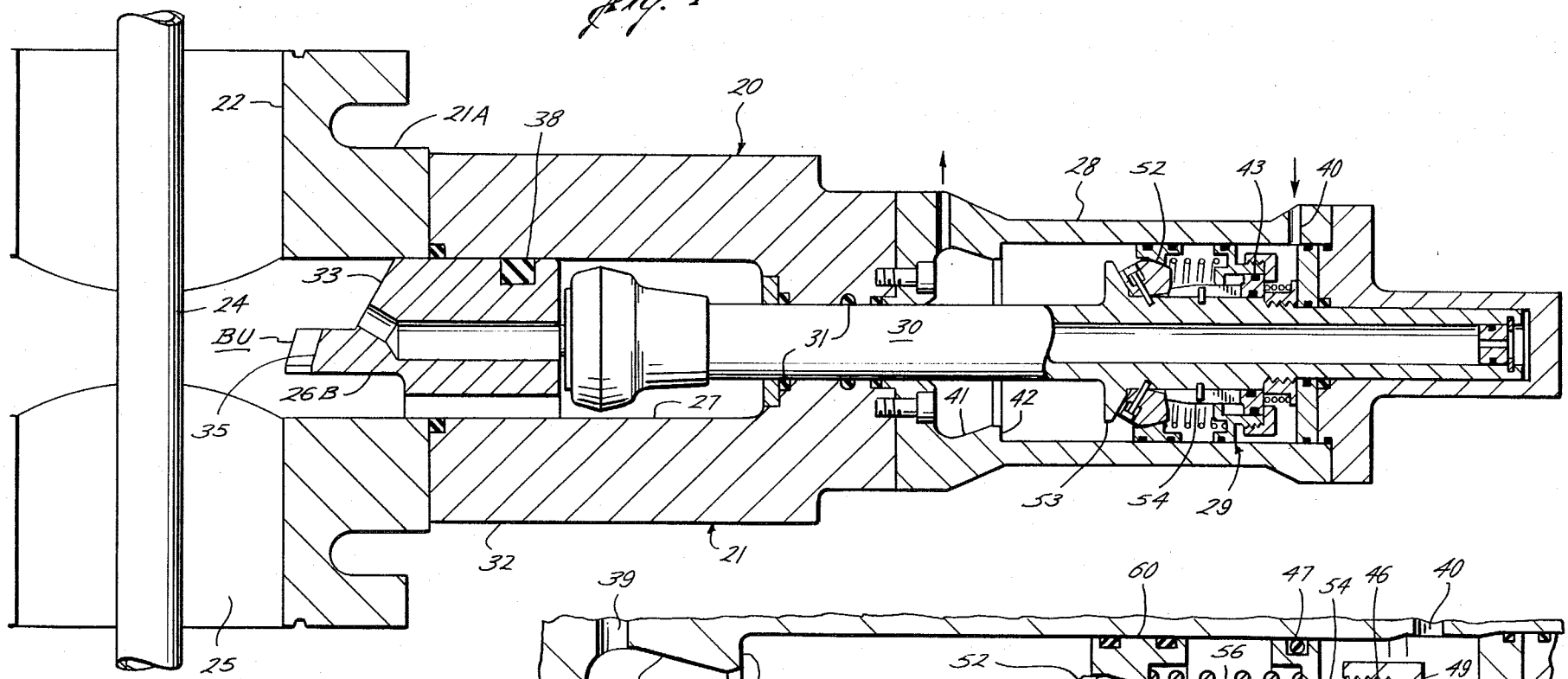
FIG. 1 is a vertical sectional view of one side of a blowout preventer having shear rams which are in open position, and an actuator for the rams constructed in accordance with the present invention.
Figure 1A:
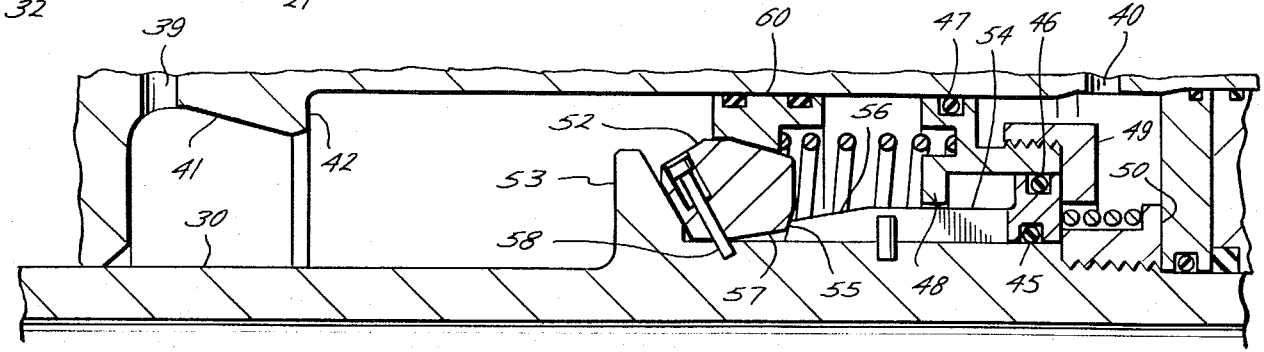
FIG. 1A is an enlarged vertical sectional view of a portion of the right-hand actuator in the position of FIG. 1.
Figures 2, 4:
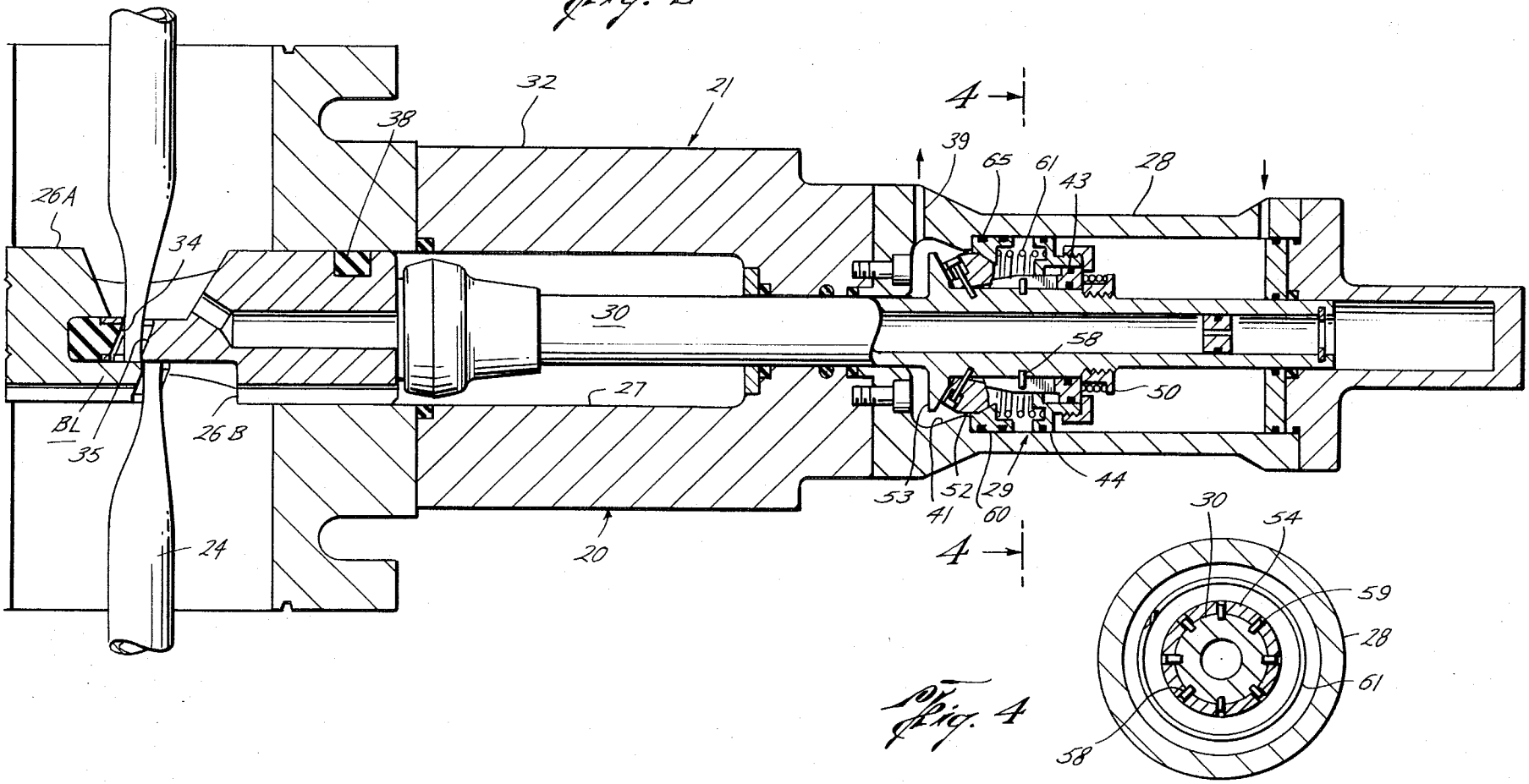
FIG. 2 is a vertical cross-sectional view similar to FIG. 1, but upon inward movement of the rams to shear the pipe and movement of the ring of the actuator into engagement with the stop shoulder in the cylinder.
FIG. 4 is a cross-sectional view of the actuator, as seen along broken lines 4—4 of FIG. 2.
Figure 3:
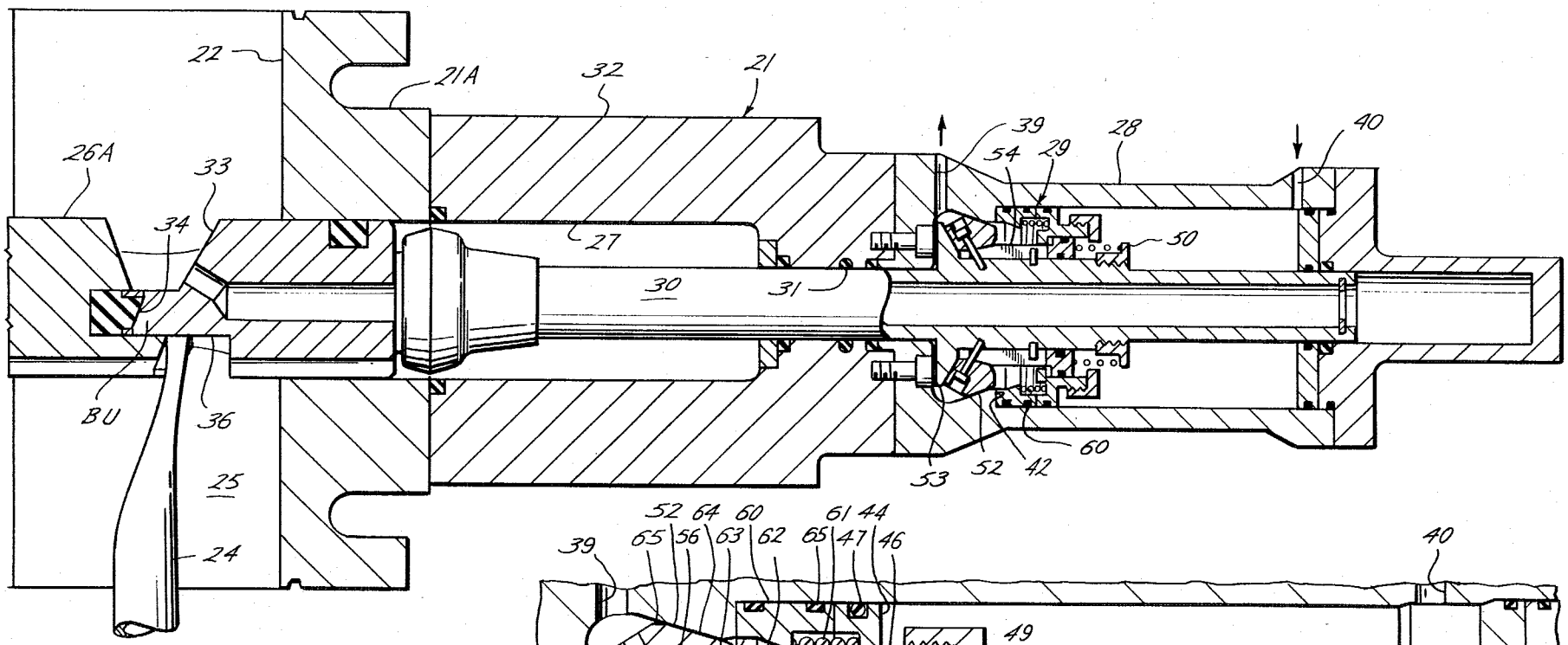
FIG. 3 is another vertical sectional view of the blowout preventer and actuator, similar to FIGS. 1 and 2, but upon further inward movement of the rams to close the blowout preventer, and movement of the locking elements inwardly out of the ring and into locking engagement with the locking shoulder in the cylinder.
Figure 3A:
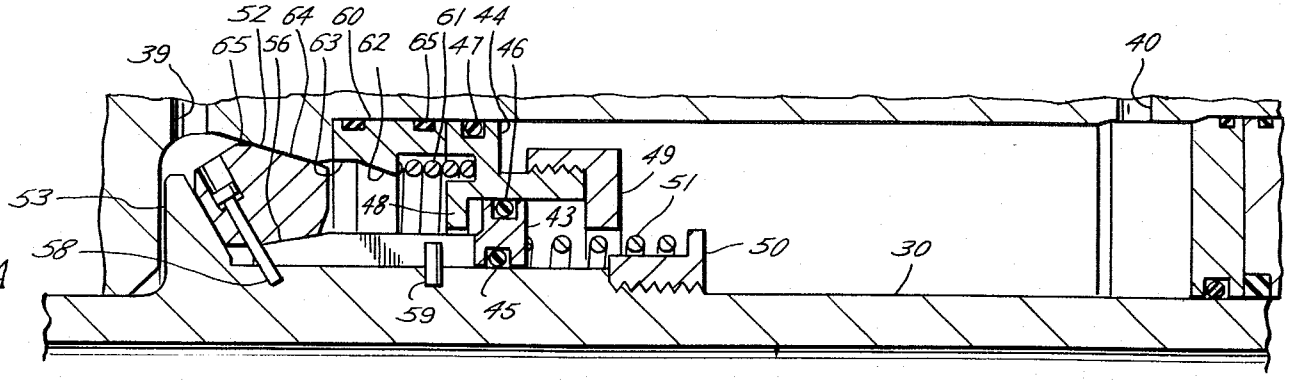
FIG. 3A is an enlarged sectional view of a portion of the actuator, as shown in FIG. 3.

With reference now to the details of the above-described drawings, the preventer shown in FIGS. 1, 2 and 3, and indicated in its entirety by reference character 20, comprises a housing 21 having a vertical bore 22 therethrough and flanges on its upper and lower ends for connecting it as a part of a wellhead with its bore in axial alignment with the bore of the wellhead. A pipe 24 which extends vertically through the bore of the preventer may be part of a drill string suspended from a drilling rig and having a bit on its lower end adapted to extend to the bottom of the well bore. As well known in the well drilling art, drilling mud would be circulated downwardly through the drill string and out the bit and then upwardly within the annulus 25 between the drill string and the bore.

The preventer includes a pair of rams 26A and 26B received with chambers 27 intersecting opposite sides of the bore 22 for movement between outer positions in which they are withdrawn from the bore, as shown in FIG. 1, during drilling of the well, and inner positions in which they are disposed across the bore, following shearing of the pipe, to seal with respect to one another and the housing so as to close the bore, as shown in FIG. 3. Each ram is moved between opened and closed positions by means of an actuator including a cylinder 28 mounted on the housing 21 outwardly of each ram chamber, piston means 29 reciprocable within each cylinder, and a rod 30 extending sealably within packing 31 within an opening through a wall of the housing separating the ram chamber from the cylinder to connect with the ram in the chamber. As will be described to follow, hydraulic fluid from an external source may be supplied to or exhausted from the cylinder on opposite sides of the piston means 29 in order to selectively move the piston means toward or away from the bore and thus the rams between their opened and closed positions.

Each housing 21 comprises a main body 21A in which the bore 22 and guideways on the inner ends of chambers are formed, and a pair of bonnets 32 each releasably connected across the outer end of a guideway in the main body to form the outer end of the ram chamber. Thus, each bonnet may be pivotally connected to one side of the main body, for movement between a closed position across the outer end of the guideway, and an open position to one side of the guideway in order to permit the rams to be removed from the chamber in order to be replaced or repaired. Alternatively, and as well known in the art, the bonnets may instead be connected to the main body of the housing by an auxiliary fluid-operated system which enables the bonnets to be moved in axial directions toward or away from the outer ends of the guideways of the main body of the housing to permit replacement and repair of the rams.

Each ram comprises a metallic ram body 33 which is generally oval-shaped in cross section for sliding axially inwardly and outwardly within the ram chamber toward and away from the bore 22, and blades BU and BL on the right and left rams 26B and 26A, respectively, having cutting edges for shearing pipe 24 as they move into overlapping relation, as shown in FIG. 2. More particularly, the cutting edge of blade BU of the upper blade on right-hand ram 26B is adapted to move over the cutting edge BL of the lower blade of left-hand ram 26B, and a packing 34 is carried by ram 26B above blade BL in position to be sealably engaged by the inner end 35 of blade 26B, upon shearing of the pipe and movement of the rams further inwardly to closed positions, as shown in FIG. 3.

In addition, and as shown and described in prior application, Ser. No. 446,390, each ram carries packing having inner face portions (not shown) at opposite sides of the laterally extending packing 34 (in the case of the left-hand ram) and the blade end 35 (in the case of the right-hand ram), as well as side portions which extend rearwardly from each such face portion along each side of the ram body, and top portions 38 which connect with the outer ends of the side portions and extend over the top of the ram. As can be seen from the drawings, and as well known in the art, the top portions 38 remain within the ram chambers as the rams move into their outer positions, whereby the rams packings form a continuous seal to close off the bore of the preventer housing.

As also shown and described in the aforementioned application, Ser. No. 446,390, the cutting edges of the lower and upper blades are of a shallow "V" shape to cooperate with one another to center the pipe as the cutting edges move toward and past one another in shearing the pipe. As shown in FIG. 3, the upper sheared end of the pipe may be lifted out of the path between the packing 34 and surface 35 to permit the rams to sealably engage one another as they are moved into closed position, and the lower end of the sheared pipe is adapted to move into a recess 36 formed in the lower side of the right-hand ram so that the pipe does not interfere with full closing movement of the rams. It will be understood, however, that this shear ram construction is merely illustrative, and that other conventional constructions may be used in the preventer of this invention.

Ports 39 and 40 connect the exterior of the cylinder 28 with the inner diameter thereof adjacent its inner and outer ends, respectively, so as to provide a means by which operating fluid may be alternately supplied to and exhausting from the cylinder on opposite sides of the piston means 29. Thus, upon introduction of operating fluid through the port 40, and exhaust of operating fluid from the port 39, the piston means may be moved inwardly to in turn move the ram from the open position of FIG. 1 to the closed position of FIG. 3. Alternatively, operating fluid may be introduced through the port 39 and exhausted through the port 40 in order to move the piston means outwardly and thereby withdraw the rams from the closed position of FIG. 3 to the open position of FIG. 1.

The inner diameter of the cylinder is reduced to provide an inwardly facing locking shouder 41 adjacent its inner end and an outwardly facing stop shoulder 42 outwardly of the locking shoulder. More particularly, locking shoulder 41 is conically shaped and extends inwardly and outwardly with respect to the axis of the cylinder, and shoulder 42 is disposed perpendicularly to the axis of the cylinder. The inner diameters of the shoulders are close to one another so that the inner diameter of the restriction in the cylinder is of minimal axial extent.

Piston means 29 includes an inner piston 43 which is sealably reciprocable along the rod 30, and an outer piston 44 which is sealably reciprocable within the cylinder and sealably reciprocable along the inner piston. Thus, as shown, inner piston 43 carries an O-ring 45 for sealably sliding along the rod, and an outer O-ring 46 for sealably sliding with respect to the inner diameter of the piston 44, and the outer piston 44 carries an O-ring 47 about its outer diameter for sealably sliding within the cylinder. For purposes to be described in detail to follow, a lost motion connection between inner piston 43 and the rod 30 permits the inner piston to be moved inwardly and outwardly with respect to the rod, and a lost motion connection between the pistons permits the outer piston 44 to be moved inwardly and outwardly with respect to the inner piston. Thus, inner and outer flanges 48 and 49 are formed on the inner diameter of piston 44 to provide shoulders which engage the inner and outer ends of piston 43 to limit their inward and outward movement with respect to one another. Also, a nut 50 is connected about the rod to provide an inwardly facing shoulder at its inner end to limit outward movement of the inner piston 43 with respect thereto, and a coil spring 51 is disposed between the outer end of piston 43 and a flange on the nut 50 so as to urge the piston 43 in an inward direction and toward an inner limited position with respect to the rod, as will be apparent from the description to follow.

As previously described, a plurality of circumferentially spaced-apart locking elements 52 are carried about the rod 30 for expansion and contraction with respect thereto as well as for axial movement inwardly and outwardly therewith. More particularly, when contracted, the locking elements 52 are disposed intermediate piston 43 and a flange 53 on the rod forwardly of the piston, as shown in FIGS. 1 and 2. As will be described to follow, the locking elements are movable with the rod through the annular restriction in the cylinder, and thus past the stop shoulder 42 formed thereon, as the rod moves inwardly and past the locking shoulder 41 thereon as the rod moves outwardly.

A locking ring 54 extends inwardly from the piston 43 for engaging the outer ends of the locking elements 52 to force their inner ends against the flange 53, and thus move the rod inwardly in response to operating fluid introduced into the cylinder at the outer side of the piston means 29. More particularly, a conical surface 55 formed on the inner end of each of the locking elements is engaged by a conical surface on the inner end of locking ring 54, which, similarly to surface 55, extends at a relatively small angle with respect to a plane perpendicular to the axis of the cylinder, so that, as the piston means moves inwardly from the outer position of FIG. 1, the inwardly directed force due to operating fluid acting over the outer side of the piston means has a relatively large axial component, but a relatively small radial component.

During this inward movement of the locking elements, they are surrounded and held in retracted position by a ring 60 reciprocable within the cylinder on the inner side of piston 44 and urged inwardly to a position surrounding the locking elements by a spring 61 acting between the ring and piston. At this time, flange 49 of piston 44 is engaged with piston 43 to urge the rod inwardly with a large force due to operating fluid acting over the outer ends of both pistons. As the rod is moved inwardly to the position of FIG. 2 to shear the pipe, the inner end of ring 60 engages stop shoulder 42, so that, as the rod continues to move inwardly from the position of FIG. 2 to the position of FIG. 3, the locking elements move out of ring 60 and are thus released from their retracted positions. More particularly, the locking elements are moved with the rod past the stop shoulder 42 and thus positions opposite the locking shoulder 41.

When piston 44 then moves against ring 60, piston 43 continues to move the rod inwardly with a lesser force, and, as the rams move into engagement with one another, the piston 43 continues to move inwardly with respect to the rod to cause the conical surfaces 55 on the locking elements to slide over the inner end of locking ring 54 and the inner ends of the locking elements to slide along a conical surface on the outer side of flange 53. The inner end of the locking ring then moves out past the conical surfaces 55 of the locking elements and an outer conical surface 56 on the locking ring moves within similarly shaped conical surfaces 57 on the inner diameters of the locking elements. These latter conical surfaces form a relatively small angle with respect to the axis of the cylinder so that continued inward movement of the inner piston and locking element with respect to the rod will move the locking elements radially outwardly into locking engagement with shoulder 50 with a relatively large component of force due to operating fluid acting on the piston 43.

As shown and described in copending application, Ser. No. 461,761, the circumferentially spaced-apart locking elements are guided for expansion and contrction with respect thereto by means of pins 58 extending through them and into the rod. Also, as shown in FIG. 4, the locking ring 54 comprises a plurality of circumferentially fingers have spaces between them which are held in alignment with pins 58 by means of one or more pins 59 mounted on the rod and extending into the spaces. As also described in the aforementioned copending application Ser. No. 461,761, conical surfaces 56 on the fingers of the locking ring extend at an angle to the axis of the actuator which is less than the friction angle between them and the locking elements so as to cooperate with the tight fit of the locking fingers on the rod to prevent unlocking when operating fluid is exhausted from the outer side of the piston means.

The locking elements are released from locking engagement with locking shoulder 41 and moved outwardly with the rod 30 past the restriction within the cylinder, automatically in response to the supply of operating fluid to the left side of the piston means and exhaustion of operating fluid from the right-hand side thereof. Thus, piston 44 will move outwardly until its flange 48 engages piston 43 and then move the inner piston outwardly with it to withdraw the locking ring 54 from within the locking elements. Piston 43 is moved against nut 50 to move the rod outwardly, and the flange 53 on the rod forces the locking elements 52 to slide downwardly and inwardly along the locking shoulder 41 and thus to pass with the rod through the annular restriction in the cylinder.

In passing through the annular restriction, the locking elements 52 move back into the ring 60 and thus are held against expansion as the rod continues to be moved outwardly from the position of FIG. 2 to that of FIG. 1. Although the outer piston 44 moves outwardly, spring 61 maintains ring 60 engaged with shoulder 42 and thus in position to receive the locking elements as they move past the restriction in the cylinder. When disposed within the holding ring 60, conical surfaces 64 about the locking elements are engaged with conical surfaces 62 on the holding ring and cylindrical surfaces 65 on the locking elements are opposite the cylindrical surface 63 of the holding ring. These cylindrical surfaces prevent the locking elements from wedging the holding ring 60 out of surrounding position about the locking elements as the locking elements continue to be moved outwardly with the operating rod. Also, of course, the holding ring will continue to be urged inwardly about the locking elements by means of the spring 61 acting between outer piston 44 and the holding ring 60.

As shown, bearing rings 65 of Teflon or other low friction material are carried about the holding ring 60 to reduce the frictional resistance to its reciprocation within the cylinder. This frictional resistance is also minimized by virtue of the fact that as the holding ring moves with the locking elements and rod between the positions of FIGS. 1 and 2, the locking elements are engaged by the relatively steep conical surface on the inner end of the locking ring, and thus, as previously noted are urged radially outwardly against the holding ring with only a relatively small axial component of the force due to operating fluid on the piston means.

From the foregoing it will be seen that this invention is one well adapted to attain all of the ends and objects hereinabove set forth, together with other advantages which are obvious and which are inherent to the apparatus.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

The invention having been described, what is claimed is:

1. A blowout preventer, comprising a housing having a bore therethrough and chambers therein intersecting the bore, a ram movable inwardly and outwardly within each chamber toward and away from the other ram or rams, said rams having cutting edges on their inner ends which cooperate with one another to shear a pipe within the bore, as the rams move inwardly toward one another, and means for sealing with respect to one another and with the chambers to close the bore, upon shearing of the pipe and continued inward movement of the rams, and an actuator for so moving each of the rams, comprising a cylinder having an inwardly facing locking shoulder near its inner end and an outwardly facing stop shoulder outwardly of the locking shoulder, an axially reciprocable rod extending from the cylinder into the chamber for connecting with the ram therein, a pair of pistons sealably reciprocable along the rod within the cylinder, respectively, and with respect to one another, means providing a lost motion connection between the pistons, means for alternately supplying operating fluid to and exhausting operating fluid from the cylinder on opposite sides of the pistons in order to move the pistons inwardly and outwardly, locking elements disposed about the rod, means mounting the locking elements on the rods for movement inwardly and outwardly therewith and for radial expansion and contraction between contracted positions in which they may move with the rod past the stop shoulder into and out of positions opposite the locking shoulder and expanded positions in which they are engageable with the locking shoulder to lock the rams in closed position, means engageable with the stop shoulder to stop inward movement of one of the pistons when the pipe has been sheared, and holding said locking elements in contracted position, as they move axially inwardly with the rod and other piston beyond the shoulder, and then releasing said locking elements for radial expansion into locking engagement with the locking shoulder, as the rod continues to move inwardly with the other piston to move the ram connected to the rod to closed position, and means responsive to inward movement of the other piston with respect to the rod for expanding the locking elements into engagement with the locking shoulder, when released, and to outward movement of the other piston with respect to the rod for releasing the locking elements from locking engagement whereby they may be contracted and moved outwardly with the rod and other piston beyond the stop shoulder as the rams are withdrawn to open position.

2. A blowout preventer of the character defined in claim 1, wherein the one piston is the outer piston.

3. A blowout preventer of the character defined in claim 1, wherein the means for engaging the stop shoulder and holding the locking elements comprises a ring which is axially reciprocable within the cylinder and which surrounds the locking elements on the inner side of the one piston to hold them in contracted position.

4. A blowout preventer of the character defined in claim 3, wherein the ring is separate from the one piston and is engageable by the one piston upon continued inward movement of the one piston following engagement of the ring with the stop shoulder, and spring means acts between the ring and one piston to urge the ring against the stop shoulder as the locking elements are contracted and moved outwardly beyond the stop shoulder.

5. A blowout preventer of the character defined in claim 4, wherein the locking elements have substantially cylindrical outer surfaces which are surrounded by substantially cylindrical surfaces on the holding ring.

6. A blowout preventer of the character defined in claim 1, wherein the locking shoulder is conical, and the locking elements have conical surfaces for locking engagement therewith.

7. A blowout preventer of the character defined in claim 1, wherein the inner diameter of the cylinder has an annular restriction with the locking shoulder formed on the inner side thereof and the stop shoulder on the outer side thereof.

8. A blowout preventer of the character defined in claim 1, including means on the other piston operable, upon expanding the locking elements into locking position, to block their contraction upon exhaustion of operating fluid from the outer sides of the pistons.

9. For use in a blowout preventer which comprises a housing having a bore therethrough and chambers therein intersecting the bore, and a ram movable inwardly and outwardly within each chamber toward and away from the other ram or rams, and wherein said rams have cutting edges on their inner ends which cooperate with one another to shear a pipe within the bore, as the rams move inwardly toward one another, and means for sealing with respect to one another and with the chambers to close the bore, upon shearing of the pipe and continued inward movement of the rams; an actuator for so moving each of the rams, comprising a cylinder adapted to be mounted on the housing at the outer end of the ram chamber and having an inwardly facing locking shoulder near its inner end and an outwardly facing stop shoulder outwardly of the locking shoulder, an axially reciprocable rod extending from one end of the cylinder and adapted to extend into the chamber for connecting with the ram therein, a pair of pistons sealably reciprocable along the rod and within the cylinder, respectively, and with respect to one another, means providing a lost motion connection between the pistons, means for alternately supplying operating fluid to and exhausting operating fluid from the cylinder on opposite sides of the pistons in order to move the pistons inwardly and outwardly, locking elements disposed about the rod, means mounting the locking elements on the rod, for movement inwardly and outwardly therewith and for radial expansion and contraction between contracted positions in which they may move with the rod past the stop shoulder into and out of positions opposite the locking shoulder and expanded positions in which they are engageable with the locking shoulder to lock the rams in closed position, means engageable with the stop shoulder to stop inward movement of one of the pistons when the pipe has been sheared, and holding said locking elements in contracted position, as they move axially inwardly with the rod and other piston beyond the stop shoulder, and then releasing said locking elements for radial expansion into locking engagement with the locking shoulder, as the rod continues to move inwardly with the other piston to move the ram connected to the rod to closed position, and means responsive to inward movement of the other piston with respect to the rod for expanding the locking elements into engagement with the locking shoulder, and to outward movement of the other piston with respect to the rod for releasing the locking elements from locking engagement, whereby they may be contracted and moved outwardly with the rod and other piston beyond the stop shoulder as the rams are withdrawn to open position.

10. An actuator of the character defined in claim 9, wherein the one piston is the outer piston which is sealably reciprocable within the cylinder.

11. An actuator of the character defined in claim 9, wherein the means for engaging the stop shoulder and holding the locking elements comprises a ring which is axially reciprocable within the cylinder, and which surrounds the locking elements on the inner side of the one piston to hold them in contracted position.

12. An actuator of the character defined in claim 11, wherein the ring is separate from the one piston and is engageable by the one piston upon continued inward movement of the one piston following engagement of the ring with the stop shoulder, and spring means acts between the ring and one piston to urge the ring against the stop shoulder as the locking elements are contracted and moved outwardly beyond the stop shoulder.

13. An actuator of the character defined in claim 12, wherein the locking elements have substantially cylindrical outer surfaces which are surrounded by substantially cylindrical surfaces on the holding ring.

14. An actuator of the character defined in claim 9, wherein the locking shoulder is conical, and the locking elements have conical surfaces for locking engagement therewith.

15. An actuator of the character defined in claim 9, wherein the inner diameter of the cylinder has an annular restriction with the locking shoulder formed on the inner side thereof and the stop shoulder on the outer side thereof.

16. An actuator of the character defined in claim 9, including means on the other piston operable, upon expanding the locking elements into locking position, to block their contraction upon exhaustion of operating fluid from the outer sides of the pistons.

* * * * *